US009086252B2

(12) United States Patent
Wang

(10) Patent No.: US 9,086,252 B2
(45) Date of Patent: Jul. 21, 2015

(54) AUTOMATIC SHOOTING RIBBON DISPENSER

(71) Applicant: Yu-Jen Wang, Taichung (TW)

(72) Inventor: Yu-Jen Wang, Taichung (TW)

( * ) Notice: Subject to any disclaimer, the term of this patent is extended or adjusted under 35 U.S.C. 154(b) by 108 days.

(21) Appl. No.: 14/049,231

(22) Filed: Oct. 9, 2013

(65) Prior Publication Data

US 2015/0096545 A1 Apr. 9, 2015

(51) Int. Cl.
*F41B 11/642* (2013.01)
*F41B 11/80* (2013.01)
*F41B 11/54* (2013.01)

(52) U.S. Cl.
CPC ..... *F41B 11/80* (2013.01); *F41B 11/54* (2013.01)

(58) Field of Classification Search
CPC ..... F41B 11/54; F41B 11/642; F41B 11/643; F41B 11/646; F41B 11/647; F41B 11/89
USPC ..... 124/72, 63–67, 48, 54, 58, 59; 446/473
See application file for complete search history.

(56) References Cited

U.S. PATENT DOCUMENTS

| | | | | |
|---|---|---|---|---|
| 5,186,156 | A * | 2/1993 | Clayton | 124/59 |
| 5,535,729 | A * | 7/1996 | Griffin et al. | 124/66 |
| 8,113,188 | B2 * | 2/2012 | Ma | 124/59 |
| 8,146,579 | B2 * | 4/2012 | Jablonski et al. | 124/65 |
| 8,567,380 | B2 * | 10/2013 | Nugent | 124/65 |
| 2009/0117823 | A1 * | 5/2009 | Wang | 446/473 |

* cited by examiner

*Primary Examiner* — Samir Abdosh
*Assistant Examiner* — John D Cooper

(57) ABSTRACT

A ribbon dispenser includes a body with a front cover. A cylinder is rotatably located in the body and has multiple chambers in which ribbons are received. An inlet is defined through the rear end of each chamber. A striking unit is located in the body and located behind the cylinder to introduce air into the chambers via the inlets. A revolving unit is connected to the cylinder to revolve the cylinder. A rigger is pivotably connected to the body has a driving portion to drive the striking unit. A stud protrudes from one side of the trigger so as to drive the revolving unit. The ribbons are ejected out from the body when the striking unit introduces air into the chambers. The cylinder is revolved to allow the ribbons in each room are ejected in sequence.

5 Claims, 7 Drawing Sheets

AUTOMATIC SHOOTING RIBBON DISPENSER

FIELD OF THE INVENTION

The present invention relates to a ribbon dispenser, and more particularly, to a ribbon dispenser which is able to dispense the ribbons consecutively.

BACKGROUND OF THE INVENTION

The conventional colored ribbon dispensers are used in entertainment events and able to dispense colored ribbons in the air to increase the mood of the performances.

Most of the ribbon dispensers can only shoot one time, the ribbons have to be reloaded to the dispensers after shooting. Some of the ribbon dispensers have a cylinder which includes multiple chambers so that the user revolves the cylinder to shoot the ribbons in another chamber of the cylinder. However, this requires the user to operate the cylinder and involve a certain level of complicity.

The present invention intends to provide a ribbon dispenser that can dispense the ribbons consecutively so as to improve the shortcomings of the conventional ribbon dispensers.

SUMMARY OF THE INVENTION

The present invention relates to a ribbon dispenser and the ribbons in each chamber of the cylinder are ejected consecutively by pulling the trigger. The pulling of the trigger revolves the revolving unit so that the trigger can be pulled consecutively to continuously eject the ribbons from the chambers of the cylinder. The cylinder can be reloaded when needed.

Thus, it is an object of the present invention to provide a ribbon dispenser which comprises a body being a hollow body; a front cover pivotably connected to a front end of the body and having a hole which communicates with an interior of the body; a cylinder rotatably located in the body and located behind a rear end of the front cover, the cylinder having multiple chambers in which ribbons are received, the chambers being arranged radially about a center of the cylinder, an opening of each chamber located behind the rear end of the front cover, an inlet defined through a rear end of each chamber; a striking unit located in the body and located behind the cylinder so as to introduce air into the chambers via the inlets; a revolving unit located in the body and connected to the cylinder so as to revolve the cylinder, and a trigger pivotably connected to the body and located outside of the body, the trigger having a driving portion on a rear end thereof so as to drive the striking unit, a stud protruding from a side of the trigger so as to drive the revolving unit.

It is a further object of the present invention to provide a striking unit which comprises a tube, a piston, a compression spring, an arm, a link and a pawl, the tube is located behind the rear end of the cylinder and has an outlet defined in a front end thereof, the piston is located in the tube and the compression spring is located on a rear end of the piston so as to push the piston toward the cylinder, a front end of the arm is pivotably connected to the rear end of the piston and a rear end of the arm is pivotably connected to a front end of the link, a rear end of the link is pivotably connected to the pawl which is pivotably connected to the body, the pawl has a tip which extends to a rotation area of the driving portion and located above the driving member so that the driving member is able to push the pawl which pivots the link toward a rear end of the body, a torsion spring is connected between the link and the pawl, the revolving unit has a rod, an extension spring, a revolving member and a shaft, the rod has two protrusions respectively extending from one side thereof, the body has a restriction slot defined therein and the two protrusions are located within the restriction slot, the rod extends through a guide slot which has a first end extending toward a top of the body and a second end of the guide slot extending toward a bottom of the body, the stud is pivotably located in the guide slot so as to move the rod toward the cylinder, a push member extends from the other one side of the rod which pivots the revolving member, the push member has a first inclined face and a second inclined face respectively formed on front and rear end thereof, a front end of the extension spring is connected to a rear end of the rod, a rear end of the extension spring is connected to an inside of the body so as to move the rod toward the rear end of the body, the revolving member is located behind the cylinder and the revolving member is connected to the shaft which is connected to the cylinder so that the revolving member and the cylinder are co-rotated with each other, the revolving member has multiple first guide members and multiple second guide members on outside thereof, the first guide members are located adjacent to a first end of the revolving member, the first end of the revolving member is located remote from the cylinder, the second guide members are located adjacent to a second end of the revolving member, the second end of the revolving member is located close to the cylinder, a first notch is defined between any two adjacent first guide members, a second notch is defined between any two adjacent second guide members, the first guide members are located corresponding to the second notches, the second guide members are located corresponding to the first notches, each of the first guide members has a first curved face on one side thereof, the first curved face is located to face an opening of the second notch, each of the second guide members has a second curved face on one side thereof, the second curved face is located to face an opening of the first notch, the push member is moved back and forth between the first and second notches to revolve the revolving member.

Another object of the present invention is to provide a cylinder has an engaging slot on the rear end thereof and the shaft is engaged with the engaging slot so that the revolving member drives the shaft to revolve the cylinder.

Another object of the present invention is to provide a piston has at least one piston ring mounted thereto which is in contact with an inside of the tube.

Another object of the present invention is to provide a front end of the compression spring is located adjacent to the rear end of the cylinder and a rear end of the compression spring is located adjacent to two stops of the body.

Another object of the present invention is to provide a pawl has a first surface formed on a top thereof and the link has a second surface which is rested on the first surface so that the pawl pivots the link toward the rear end of the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
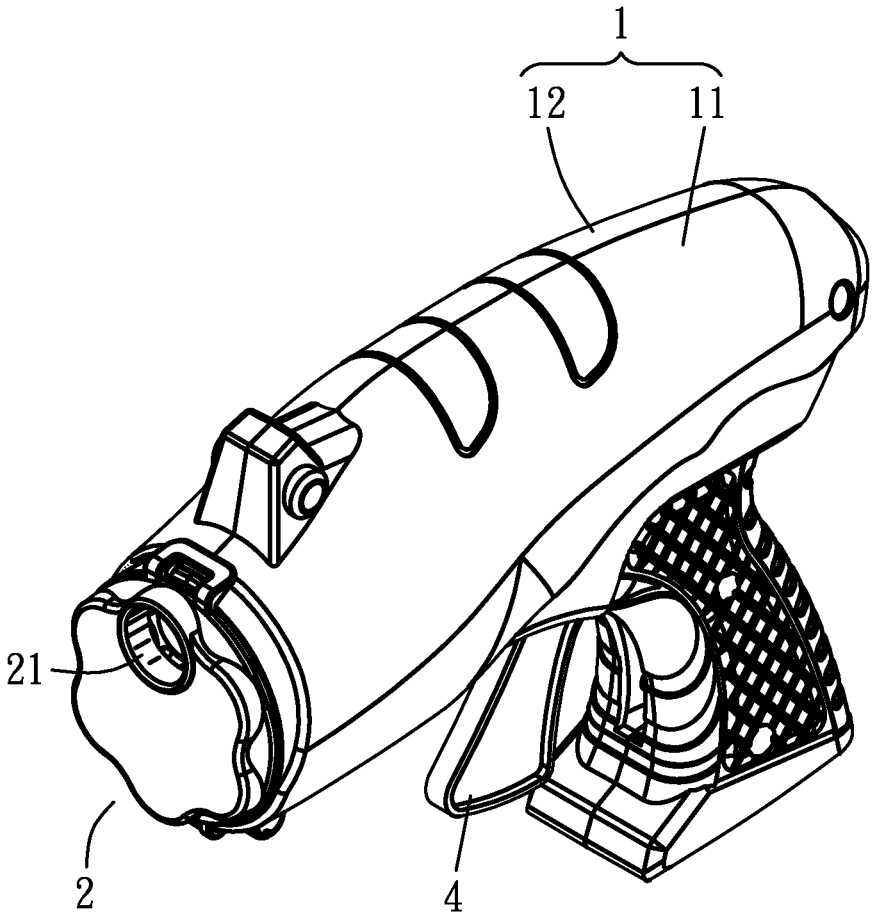
FIG. 1 is a perspective view to show the ribbon dispenser of the present invention.
Figure 2:
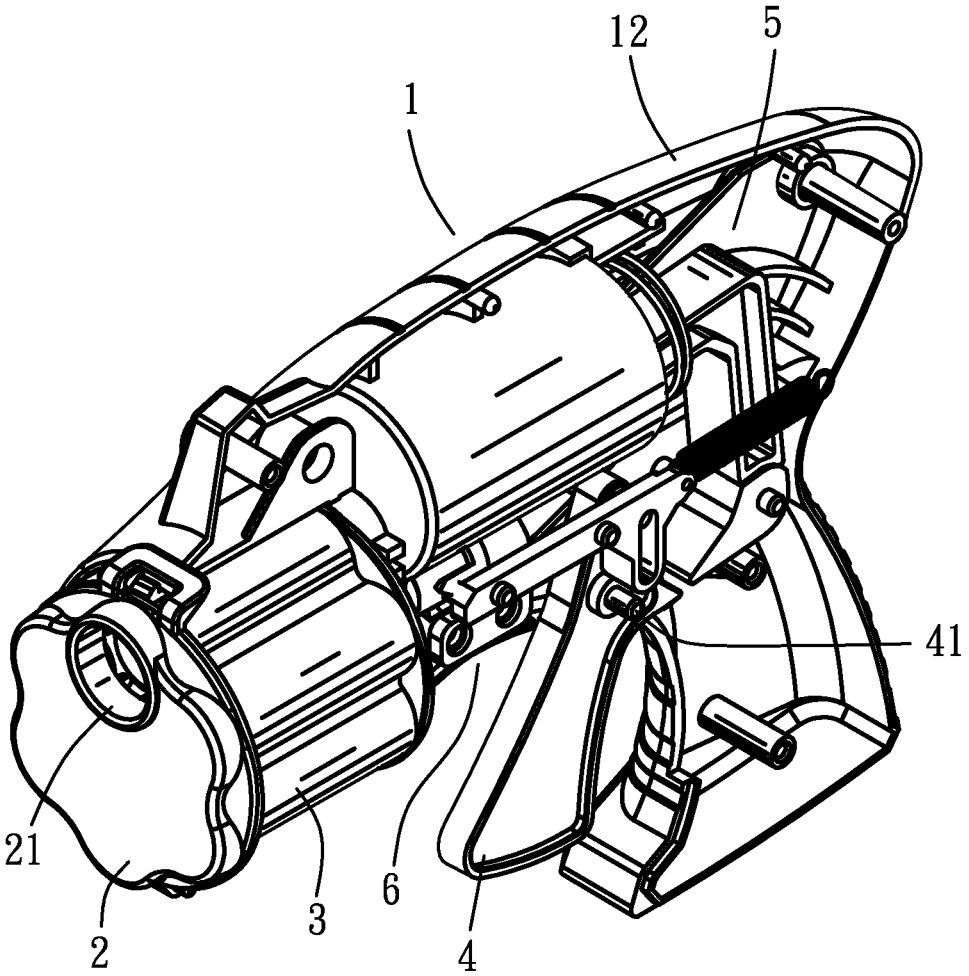
FIG. 2 is a perspective view to show the ribbon dispenser of the present invention, wherein the right case is removed.

Referring to FIGS. 1 and 2, the ribbon dispenser of the present invention comprises a body 1, a front cover 2, a cylinder 3, a trigger 4, a striking unit 5 and a revolving unit 6, wherein the body 1 is a hollow body composed of a right case 11 and a left case 12. The front cover 2 is pivotably connected to the front end of the body 1. The front cover 2 has a hole 21 which communicates with the interior of the body 21.

The cylinder 3 is rotatably located in the body 1 and located behind the rear end of the front cover 2, so that the cylinder 3 can be installed into the body 1 or removed from the body 1 via the front end of the body 1.

The trigger 4 is pivotably connected to the body 1 and located outside of the body 1. The trigger 4 has a pivot 41 which is pivotably connected between the right and left cases 11, 12 so that when the trigger 4 is pivoted, the trigger 4 is pivoted about the pivot 41. The striking unit 5 is located in the body 1 and located behind the cylinder 3 so as to introduce air into the chambers 32 via the inlets 33. The revolving unit 6 is located in the body 1 and connected to the cylinder 3 so as to revolve the cylinder 3.

Figure 3:
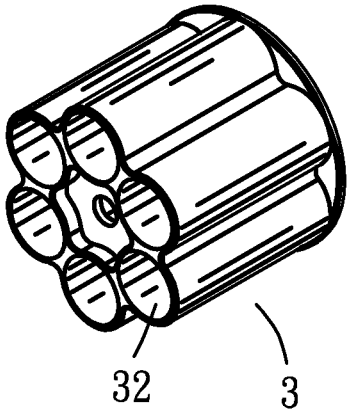
FIG. 3 is a perspective view to show the cylinder of the ribbon dispenser of the present invention.
Figure 4:
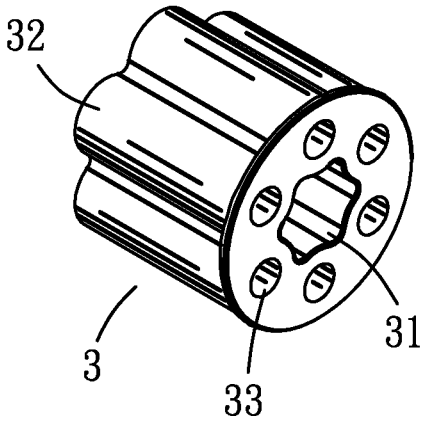
FIG. 4 is another perspective view to show the cylinder of the ribbon dispenser of the present invention.

As shown in FIGS. 3 and 4, the cylinder 3 has an engaging slot 31 on the rear end thereof and comprises multiple chambers 32 in which ribbons (not shown) are received. The chambers 32 are arranged radially about the center of the cylinder 3. Each chamber 32 has an opening located behind the rear end of the front cover 2 as shown in FIG. 2. An inlet 33 is defined through the rear end of each chamber 32 so that the ribbons are ejected from the hole 21 of the body 1 as shown in FIG. 1. The shape of the engaging slot 31 can be triangular slot, polygon slot, oval slot or any known slot.

Figure 5:
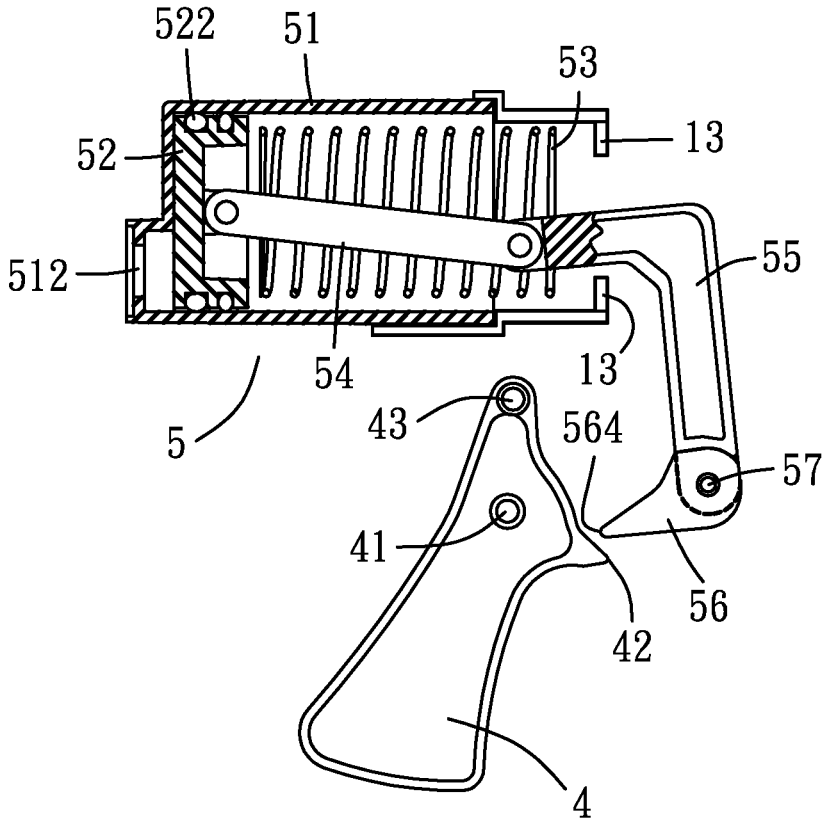
FIG. 5 shows the trigger and the striking unit, wherein the striking unit is shown by cross sectional view.

As shown in FIGS. 2 and 5, the trigger 4 has a driving portion 42 on the rear end thereof so as to drive the striking unit 5.

Figure 6:
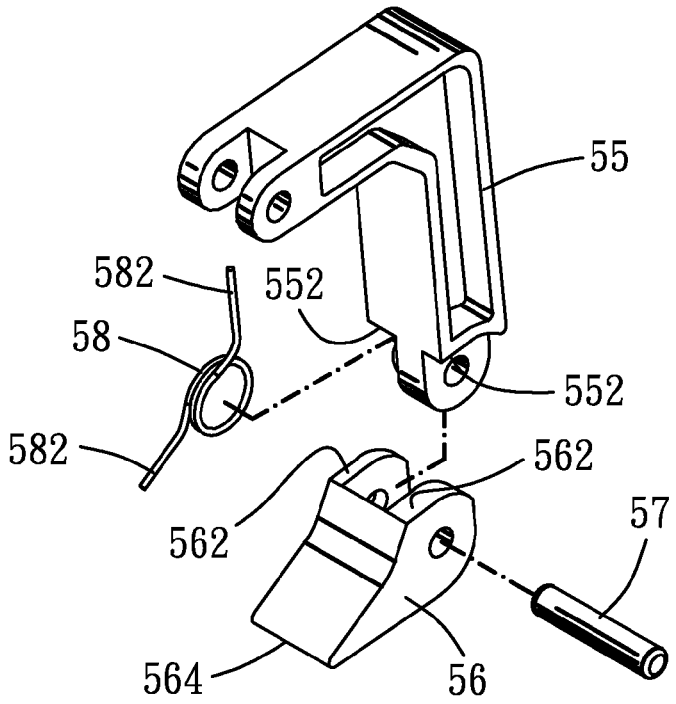
FIG. 6 is a perspective view to show the link and pawl of the striking unit of the ribbon dispenser of the present invention.

The striking unit 5 comprises a tube 51, a piston 52, a compression spring 53, an arm 54, a link 55 and a pawl 56. The tube 51 is located behind the rear end of the cylinder 3 and has an outlet 512 defined in the front end thereof and the outlet 512 is located corresponding to the cylinder 3. The piston 62 is located in the tube 51 and has at least one piston ring 522 mounted thereto which is in contact with an inside of the tube 51 so as to provide better air-tightness. The compression spring 53 is located on the rear end of the piston 52 so as to push the piston 532 toward the cylinder 3. The front end of the compression spring 53 is located adjacent to the rear end of the cylinder 52 and the rear end of the compression spring 53 is located adjacent to two stops 13 of the body 1. The front end of the arm 54 is pivotably connected to the rear end of the piston 52 and the rear end of the arm 54 is pivotably connected to the front end of the link 55. As shown in FIGS. 2, 5 and 6, the pawl 56 is pivotably connected to the body 1 by a pin 57, and the rear end of the link 55 is pivotably connected to the pawl 56 by the pin 57. The pawl 56 has a first surface 562 formed on the top thereof. The pawl 56 has a tip 564 which extends to a rotation area of the driving portion 42 and located above the driving member 42 so that the driving member 42 is able to push the pawl 56 which pivots the link 55 toward the rear end of the body 1. The link 55 has a second surface 552 which is rested on the first surface 562 so that the pawl 56 pivots the link 55 about the pin 57 and toward the rear end of the body 1. A torsion spring 58 has two legs 582 which are connected between the link 55 and the pawl 56, such that the link 55 and the pawl 56 can return to their initial positions.

Figure 7:
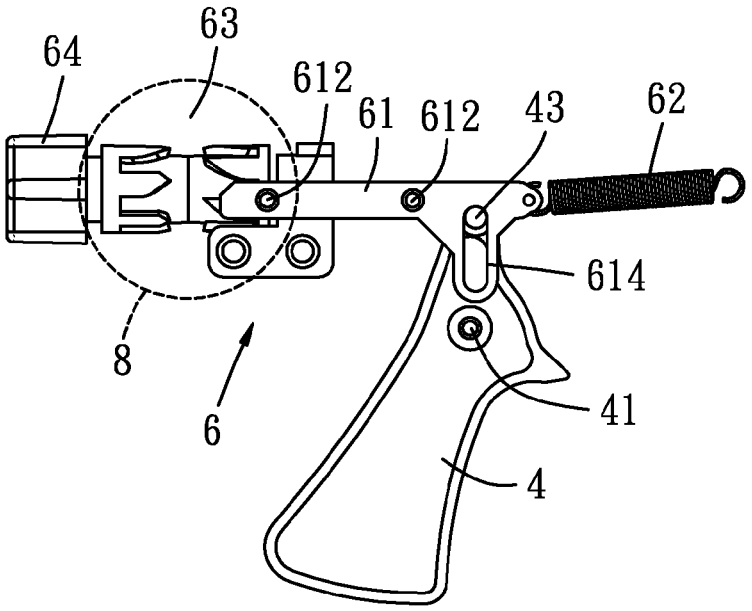
FIG. 7 is a side view to show the trigger and the striking unit.

As shown in FIGS. 2 and 7, a stud 43 protrudes from one side of the trigger 4 so as to drive the revolving unit 6. The stud 43 is located between the pivot 41 and the body 1.

Figure 10:
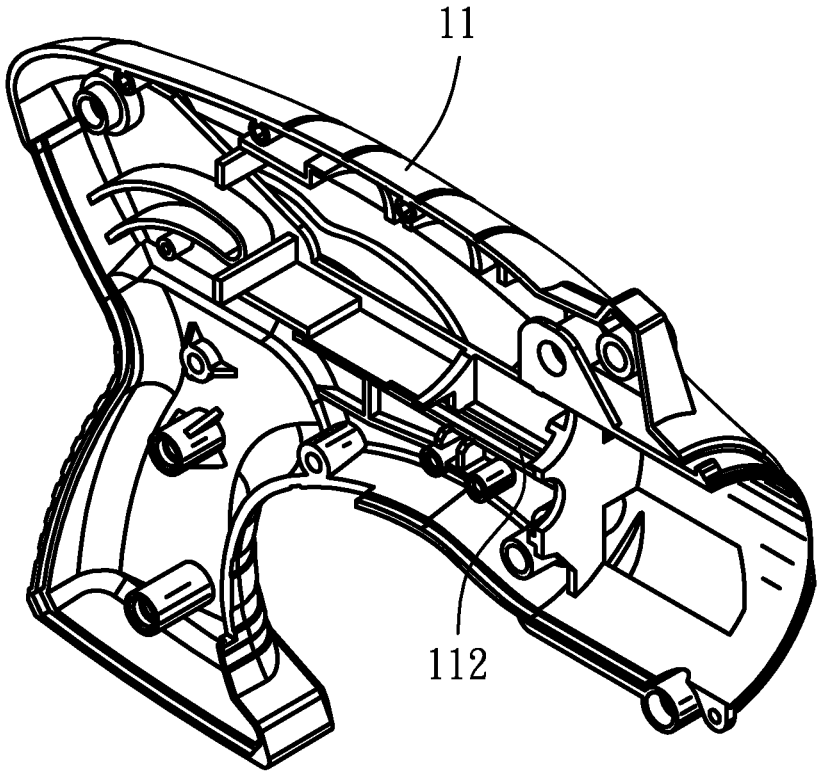
FIG. 10 shows the right case of the ribbon dispenser of the present invention.

The revolving unit 6 has a rod 61, an extension spring 62, a revolving member 63 and a shaft 64. The rod 61 has two protrusions 612 respectively extending from one side thereof. The body 1 has a restriction slot 112 defined in the right case 11 as shown in FIG. 10 and the two protrusions 612 are located within the restriction slot 112. The rod 61 extends through a guide slot 614 which has a first end extending toward a top of the body 1 and a second end of the guide slot 614 extends toward the bottom of the body 1. The stud 43 is pivotably located in the guide slot 614 so as to move the rod 61 toward the cylinder 3 when the trigger 4 is pulled. As shown in FIG. 10, a push member 616 extends from the other one side of the rod 61 which pivots the revolving member 63. The push member 616 has a first inclined face 6162 and a second inclined face 6164 respectively formed on front and rear end thereof. The front end of the extension spring 62 is hooked to the rear end of the rod 61. The rear end of the extension spring 62 is connected to the inside of the body 1 so as to move the rod 61 toward the rear end of the body 1.

Figure 8:
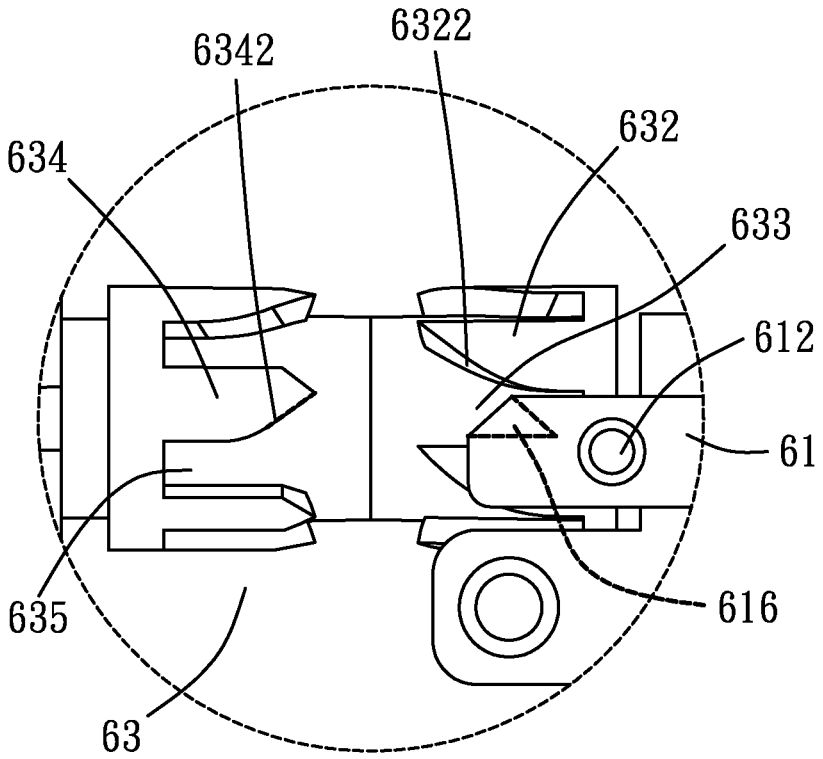
FIG. 8 shows an enlarged view of the circled portion in FIG. 7.
Figure 9:
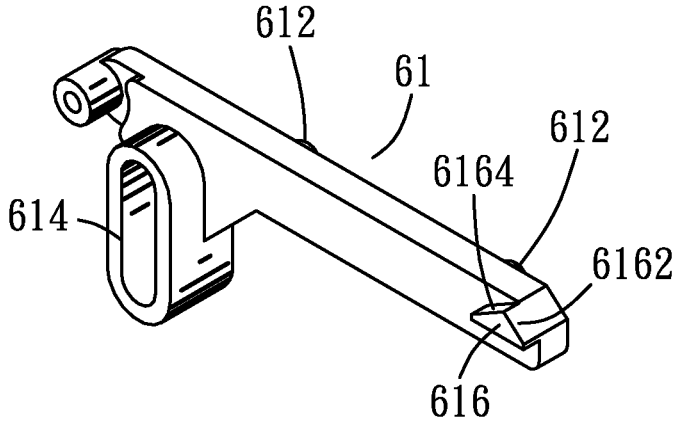
FIG. 9 shows the left perspective view of the rod of the ribbon dispenser of the present invention.

The revolving member 63 is located behind the cylinder 3 and the front end of the revolving member 63 is connected to the shaft 64 which is engaged with the engaging slot 31 of the cylinder 3 as shown in FIG. 4, so that the revolving member 63 and the cylinder 3 are co-rotated with each other. A shown in FIG. 8, the revolving member 63 has multiple first guide members 632 and multiple second guide members 634 on outside thereof. The number of each of the first and second guide members 632, 634 is the same as the number of the chambers 32 of the cylinder 3. The first guide members 632 are located adjacent to the first end of the revolving member 63, the first end of the revolving member 63 is located remote from the cylinder 3. The second guide members 634 are located adjacent to a second end of the revolving member 63, the second end of the revolving member 63 is located close to the cylinder 3. A first notch 633 is defined between any two adjacent first guide members 632. A second notch 633 is defined between any two adjacent second guide members 634. The first guide members 632 are located corresponding to the second notches 635, the second guide members 634 are located corresponding to the first notches 633. Each of the first guide members 632 has a first curved face 6322 on one side thereof, the first curved face 6322 is located to face the opening of the second notch 635. Each of the second guide members 634 has a second curved face 6342 on one side thereof, the second curved face 6342 is located to face an opening of the first notch 633. The push member 616 is moved back and forth between the first and second notches 633, 635 to revolve the revolving member 63. The rod 61 revolves the revolving member 63 by the push member 616.

When the user pulls the trigger 4 which is pivoted about the pivot 41 counter clockwise. The driving portion 42 pushes the tip 564 and the pawl 56 is pivoted clockwise about the pin 57. Because the second surface 552 is rested on the first surface 562, the pawl 56 pivots the link 55 clockwise about the pin 57 and toward the rear end of the body 1. The piston 52 is pulled by the arm 54 to suck air into the room between the piston 52 and the outlet 512. The piston 52 compresses the compression spring 53. When the tip 564 is rotated clockwise with the pawl 56 and removes from the rotation area of the driving portion 42, driving portion 42 is separated from the tip 564, so that the pawl 56 is not pushed by the driving portion 42. The compression spring 53 provides a force to move the piston 52 forward, the air in the tube 51 is pushed from the outlet 512 and enters into the chamber 32 via the inlet 33, therefore, the ribbons in the chamber 32 are ejected from the hole 21 of the body 1. The forward movement of the piston 53 makes the arm 54, the link 55 and the pawl 45 to move back to their initial positions.

Besides the ejection of the ribbons by pulling the trigger 4, the pulling of the trigger 4 also moves the stud 43 to move the rod 61 forward and the extension spring 62 is extended. After the ribbons are ejected, user releases the trigger 4 the extension spring 62 pulls the rod 61 to move backward to its initial position. When the rod 61 moves backward, the trigger 4 is pivoted clockwise about the pivot 41 to its initial position.

When the trigger 4 is pivoted clockwise, the driving portion 42 touches the tip 564 and the pawl 56 is pivoted counter clockwise about the pin 57. Because the pawl 56 is pivotably connected to the link 55 by the pin 57, and the can only drive the link 55 toward the rear end of the body 1 in one direction, so that the pawl 56 cannot drive the link 55, the arm 54 and the piston 52 when the pawl 56 is pivoted counter clockwise. The pawl 56 is rotated relative to the link 55 so as to activate the torsion spring 58. When the tip 564 and the pawl 56 are both pivoted counter clockwise, and the tip 564 is removed from the rotation area of the driving portion 42, the driving portion 42 is separated from the tip 564, so that the pawl 56 is not pushed by the driving portion 42. The torsion spring 58 provides a force to pivot the pawl 56 clockwise back to its initial position.

When the user pulls the trigger 4 and the rod 61 moves forward, the push member 616 is moved forward from the first notch 633. When the first inclined face 6162 contacts the second guide member 634 located corresponding to the first notch 633, because the shape of the first inclined face 6162 and the second curved face 6342 of the second guide member 634, the push member 616 is guided by the second curved face 6342 and enters into the second notch 635. The push member 616 pushes the second curved face 6342 laterally so that the revolving member 63 is revolved to rotate the cylinder 3. One of the inlet 33 of the cylinder 3 is located corresponding to the outlet 512 of the tube 51, so that air is introduced into the chamber 32 to eject the ribbons in the chamber 32 out from the hole 21 of the body 1.

When the user releases the trigger 4 and the rod 61 moves backward, the push member 616 is moved backward from the second notch 635. When the second inclined face 6164 contacts the first guide member 632 located corresponding to the second notch 635, because the shape of the second inclined face 6164 and the first curved face 6322 of the first guide member 632, the push member 616 is guided by the first curved face 6322 and enters into the first notch 633. The push member 616 pushes the first curved face 6322 laterally so that the revolving member 63 is revolved to rotate the cylinder 3. The outlet 512 of the tube 51 is located between two adjacent inlets 33 of the cylinder 3.

The user pulls and releases the trigger 4 to activate the striking unit 5 and revolves the revolving unit 6 to eject the ribbons, the action to the trigger 4 can be operated consecutively to eject the ribbons in the chambers 32 of the cylinder 3 consecutively without any extra action needed. After all of the ribbons in the chambers 32 are ejected, the user can open the front cover 2 to replace a new cylinder 3 and the ribbon dispenser can be used again within short period of time.

While we have shown and described the embodiment in accordance with the present invention, it should be clear to those skilled in the art that further embodiments may be made without departing from the scope of the present invention.

What is claimed is:

1. A ribbon dispenser comprising:

a body being a hollow body;

a front cover pivotably connected to a front end of the body and having a hole which communicates with an interior of the body;

a cylinder rotatably located in the body and located behind a rear end of the front cover, the cylinder having multiple chambers in which ribbons are received, the chambers being arranged radially about a center of the cylinder, an opening of each chamber located behind the rear end of the front cover, an inlet defined through a rear end of each chamber;

a striking unit located in the body and located behind the cylinder so as to introduce air into the chambers via the inlets;

a revolving unit located in the body and connected to the cylinder so as to revolve the cylinder, and a trigger pivotably connected to the body and located outside of the body, the trigger having a driving portion on a rear end thereof so as to drive the striking unit, a stud protruding from a side of the trigger so as to drive the revolving unit, wherein the striking unit comprises a tube, a piston, a compression spring, an arm, a link and a pawl, the tube is located behind the rear end of the cylinder and has an outlet defined in a front end thereof, the piston is located in the tube and the compression spring is located on a rear end of the piston so as to push the piston toward the cylinder, a front end of the arm is pivotably connected to the rear end of the piston and a rear end of the arm is pivotably connected to a front end of the link, a rear end of the link is pivotably connected to the pawl which is pivotably connected to the body, the pawl has a tip which extends to a rotation area of the driving portion and located above the driving member so that the driving member is able to push the pawl which pivots the link toward a rear end of the body, a torsion spring is connected between the link and the pawl, the revolving unit has a rod, an extension spring, a revolving member and a shaft, the rod has two protrusions respectively extending from one side thereof, the body has a restriction slot defined therein and the two protrusions are located within the restriction slot, the rod extends through a guide slot which has a first end extending toward a top of the body and a second end of the guide slot extending toward a bottom of the body, the stud is pivotably located in the guide slot so as to move the rod toward the cylinder, a push member extends from the other one side of the rod which pivots the revolving member, the push member has a first inclined face and a second inclined face respectively formed on front and rear end thereof, a front end of the extension spring is connected to a rear end of the rod, a rear end of the extension spring is connected to an inside of the body so as to move the rod toward the rear end of the body, the revolving member is located behind the cylinder and the revolving member is connected to the shaft which is connected to the cylinder so that the revolving member and the cylinder are co-rotated with each other, the revolving member has multiple first guide members and multiple second guide members on outside thereof, the first guide members are located adjacent to a first end of the revolving member, the first end of the revolving member is located remote from the cylinder, the second guide members are located adjacent to a second end of the revolving member, the second end of the revolving member is located close to the cylinder, a first notch is defined between any two adjacent first guide members, a second notch is defined between any two adjacent second guide members, the first guide members are located corresponding to the second notches, the second guide members are located corresponding to the first notches, each of the first guide members has a first curved face on one side thereof, the first curved face is located to face an opening of the second notch, each of the second guide members has a second curved face on one side thereof, the second curved face is located to face an opening of the first notch, the push member is moved back and forth between the first and second notches to revolve the revolving member.

2. The dispenser as claimed in claim 1, wherein the cylinder has an engaging slot on the rear end thereof and the shaft is engaged with the engaging slot so that the revolving member drives the shaft to revolve the cylinder.

3. The dispenser as claimed in claim 1, wherein the piston has at least one piston ring mounted thereto which is in contact with an inside of the tube.

4. The dispenser as claimed in claim 1, wherein a front end of the compression spring is located adjacent to the rear end of the cylinder and a rear end of the compression spring is located adjacent to two stops of the body.

5. The dispenser as claimed in claim 1, wherein the pawl has a first surface formed on a top thereof and the link has a second surface which is rested on the first surface so that the pawl pivots the link toward the rear end of the body.

* * * * *